US007283022B2

(12) United States Patent
Andreasson et al.

(10) Patent No.: US 7,283,022 B2
(45) Date of Patent: Oct. 16, 2007

(54) DUAL MODE CERAMIC FILTER

(75) Inventors: Krister Andreasson, Stockholm (SE); Goran Poshman, Vallentuna (SE)

(73) Assignee: Powerwave Technologies, Inc., Santa Ana, CA (US)

( * ) Notice: Subject to any disclaimer, the term of this patent is extended or adjusted under 35 U.S.C. 154(b) by 0 days.

(21) Appl. No.: 11/349,463

(22) Filed: Feb. 7, 2006

(65) Prior Publication Data

US 2006/0176129 A1 Aug. 10, 2006

Related U.S. Application Data

(60) Provisional application No. 60/651,182, filed on Feb. 9, 2005.

(51) Int. Cl.
*H01P 7/10* (2006.01)
*H01P 1/20* (2006.01)

(52) U.S. Cl. ..... 333/219.1; 333/202; 333/227; 333/235

(58) Field of Classification Search ..... None
See application file for complete search history.

(56) References Cited

U.S. PATENT DOCUMENTS

| | | | | |
|---|---|---|---|---|
| 4,642,591 | A | 2/1987 | Kobayashi | 333/227 |
| 4,760,361 | A | 7/1988 | Kobayashi | 333/209 |
| 5,083,102 | A | 1/1992 | Zaki | 333/212 |
| 5,638,037 | A * | 6/1997 | Kurisu et al. | 333/202 |
| 5,708,404 | A | 1/1998 | Kurisu et al. | 333/202 |
| 5,710,530 | A * | 1/1998 | Wada et al. | 333/219.1 |
| 5,796,318 | A * | 8/1998 | Ando et al. | 333/202 |
| 5,796,320 | A | 8/1998 | Hattori et al. | 333/219.1 |
| 5,898,349 | A | 4/1999 | Hattori et al. | 333/202 |
| 6,031,436 | A | 2/2000 | Fiedziuszko et al. | 333/202 |
| 6,278,344 | B1 * | 8/2001 | Kurisu et al. | 333/202 |
| 6,538,533 | B1 | 3/2003 | Hwang et al. | 333/202 |
| 6,650,208 | B2 * | 11/2003 | Karhu | 333/202 |
| 6,664,873 | B2 | 12/2003 | Tiihonen | 333/219.1 |
| 6,756,865 | B2 | 6/2004 | Saito et al. | 333/134 |
| 6,904,666 | B2 | 6/2005 | Alford | 29/592.1 |
| 6,954,122 | B2 | 10/2005 | Wilber et al. | 333/202 |
| 2002/0190817 | A1 | 12/2002 | Berry et al. | 33/202 |
| 2003/0117244 | A1 | 6/2003 | Matsuura et al. | 333/219 |

* cited by examiner

*Primary Examiner*—Robert Pascal
*Assistant Examiner*—Kimberly E Glenn
(74) *Attorney, Agent, or Firm*—Myers Dawes Andras & Sherman LLP

(57) ABSTRACT

A dual mode ceramic filter has an enclosure with two cavities separated by a wall, and two TM dual-mode resonators, each TM dual-mode resonator positioned in a corresponding cavity. Each TM dual-mode resonator has first and second modes, and a body having a central portion with a plurality of arms extending outwardly from the central portion. The filter also has two input conductive members, each input conductive members positioned in a corresponding cavity. Each input conductive member is disposed proximate a corresponding TM dual-mode resonator for coupling between the input conductive member and the TM dual-mode resonator.

45 Claims, 14 Drawing Sheets

FIG. 1A
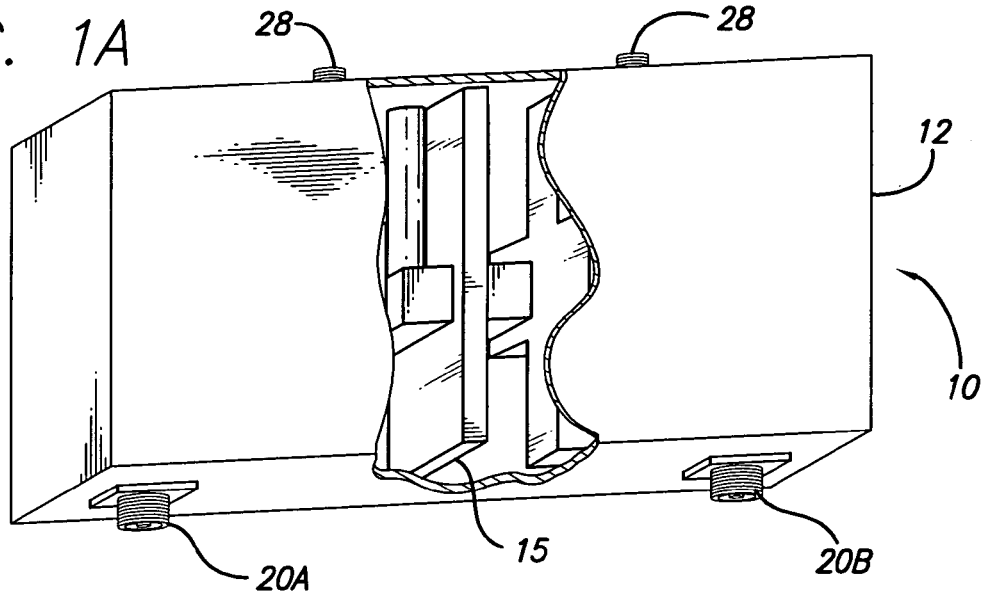
FIG. 1B
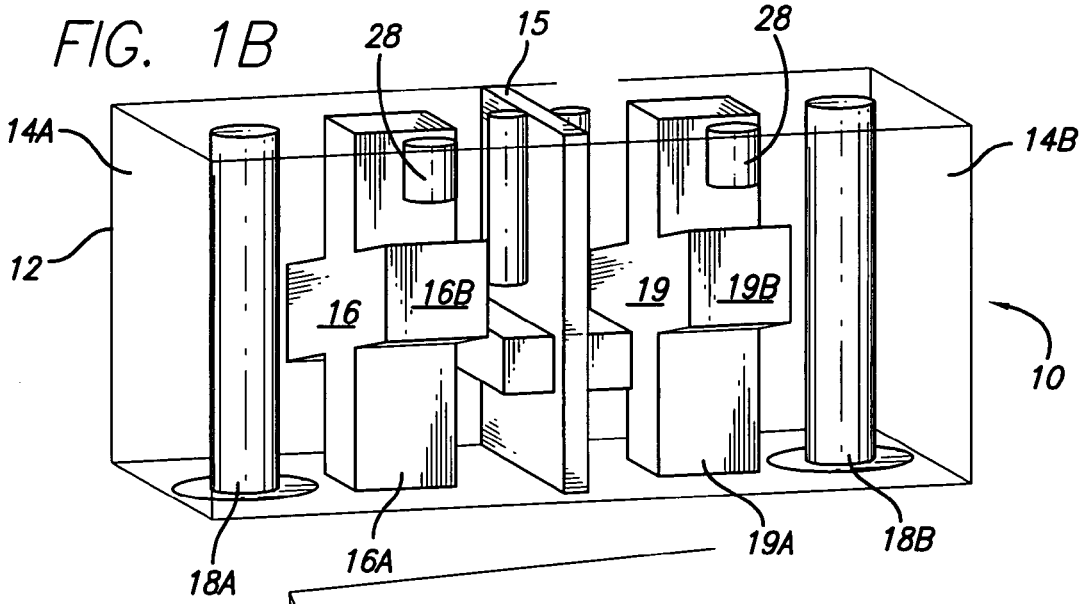
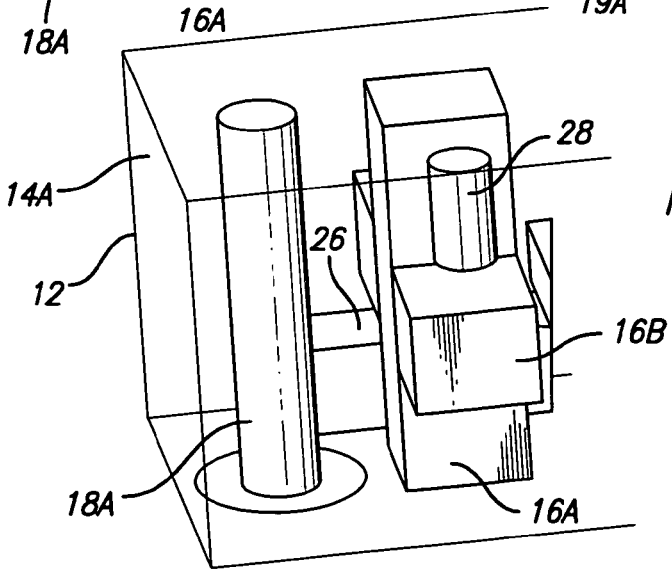
FIG. 1C

DUAL MODE CERAMIC FILTER

RELATED APPLICATION INFORMATION

The present application claims priority under 35 USC 119(e) of provisional patent application Ser. No. 60/651,182, filed on Feb. 9, 2005, incorporated herein by reference in its entirety.

FIELD OF THE INVENTION

The present invention is directed to filters for wireless communications systems, and in particular, wireless base station filters.

BACKGROUND OF THE INVENTION

A wireless telecommunication system typically includes a plurality of base stations connected to a communication network. Each base station includes radio transceivers associated with a transmission tower. A typical base station includes one or more filters for processing IF signals. One such filter is known as a microwave cavity filter which includes resonators formed in cavities in order to provide a desired frequency response when signals are input to the filter.

One type of cavity filter design employs dual-mode resonators utilized in the cavity filters, providing desired filter functions while reducing the filter size compared to conventional cavity filters utilizing single mode resonators. However, many existing dual-mode resonators are difficult to manufacture due to the shape of the resonator structure. Other existing resonators that use hybrid modes, are too large and bulky for certain applications.

Accordingly, an objective of the present invention is to provide a structure for smaller base station cavity filters which avoids the above-noted problems.

SUMMARY OF THE INVENTION

In one embodiment, the present invention provides a filter comprising; an enclosure having a cavity; a TM dual-mode resonator in the cavity, the TM dual-mode resonator having first and second modes and comprising a TM dielectric resonator body having a central portion with a plurality of arms extending outwardly from the central portion; and an input conductive member in the cavity. The input conductive member is disposed proximate the TM dual-mode resonator for coupling between the input conductive member and the TM dual-mode resonator.

Preferably, the dielectric resonator body comprises a cross shape, and the filter further comprises at least one tuning member that is adjacent one or more of the plurality of arms. The filter preferably further comprises a tuning member that is positioned adjacent or more of the plurality of arms, for tuning a magnetic field in the cavity. Preferably, all tuning is in the same direction.

In one example of the filter, at least two of the arms are offset relative to the central portion of the dielectric resonator body. In another example of the filter, the dielectric resonator body comprises an "X" shape, the cavity is essentially rectangular with essentially parallel top and bottom surfaces, and one arm of the dielectric resonator body is transverse relative to said cavity surfaces. Two or more arms of the dielectric resonator body can be transverse relative to said cavity surfaces, wherein a transmission zero is close to the bandbass of the filter.

In another example, the cavity can be essentially rectangular with essentially back and front surfaces, wherein the input conductive member is transverse relative to said cavity surfaces.

The filter can further comprise a first tuning member positioned proximate the dielectric resonator body in the cavity to preset the coupling, and a second tuning member positioned proximate the dielectric resonator body in the cavity for fine-tuning. The first tuning member comprises a step in a corner of the cavity, and the second tuning member comprises a tuning screw. The tuning members comprise metals covered with dielectric film.

In another example, the cavity is essentially rectangular with essentially parallel top and bottom surfaces, and essentially parallel front and back surfaces, and at least one arm of the dielectric resonator body is transverse relative to said cavity top and bottom surfaces, and the input conductive member is transverse relative to said top and bottom cavity surfaces.

In another aspect, the present invention provides another filter comprising; an enclosure having two cavities separated by a wall; two TM dual-mode resonators, each TM dual-mode resonator positioned in a corresponding cavity, each TM dual-mode resonator having first and second modes and comprising a TM dielectric resonator body having a central portion with a plurality of arms extending outwardly from the central portion; and two input conductive members, each input conductive members positioned in a corresponding cavity. Each input-conductive member is disposed proximate a corresponding TM dual-mode resonator for coupling between the input conductive member and the TM dual-mode resonator.

Preferably, the filter further comprises a tuning member for each cavity, positioned adjacent one or more of the plurality of arms of the dielectric resonator body in the cavity. A mode tuning member can be positioned adjacent two of the plurality of arms. The filter can include a tuning member for each cavity, positioned adjacent or more of the plurality of arms of the dielectric resonator body in the cavity, for tuning a magnetic field in the cavity. At least two of the arms of the dielectric resonator body in each cavity may be offset relative to the central portion of the dielectric resonator body. At least one dielectric resonator body preferably comprises an "X" shape.

In another example of the filter, for each cavity, a first tuning member is positioned proximate the dielectric resonator body in the cavity to preset the coupling, and a second tuning member positioned proximate the dielectric resonator body in the cavity for fine-tuning. For each cavity, the first tuning member comprises a step in a corner of the cavity, and the second tuning member comprises a tuning screw.

Further, each cavity is essentially rectangular with essentially parallel top and bottom surfaces, and essentially parallel front and back surfaces; at least one arm of the dielectric resonator body in each cavity is transverse relative to said cavity top and bottom surfaces; and the corresponding input conductive member is transverse relative to said top and bottom cavity surfaces.

In another aspect, the present invention provides another filter comprising; an enclosure having two cavities separated by a wall; two TM dual-mode resonators, each TM dual-mode resonator positioned in a corresponding cavity, each TM dual-mode resonator having first and second modes and comprising a TM dielectric resonator body having a central portion with a plurality of arms extending outwardly from the central portion; two input conductive members, each input conductive members positioned in a corresponding cavity, wherein each input conductive member is disposed proximate a corresponding TM dual-mode resonator for coupling between the input conductive member and the TM dual-mode resonator; and a cross-coupling member disposed in the two cavities via a opening in the wall for coupling between resonator modes.

The cross-coupling member is positioned adjacent the TM dielectric resonator bodies. In one example, the cross-coupling member providing coupling between resonator modes 1 and 4. Preferably, the cross-coupling member comprises a closed loop which is not connected to cavity surfaces, and can comprise an "8" shape. The cross-coupling member is printed on a double-sided substrate.

In another aspect, the present invention provides another filter comprising; an enclosure having a cavity; a TM dual-mode resonator in the cavity, the TM dual-mode resonator having first and second modes and comprising a TM dielectric resonator body having a central portion with a plurality of arms extending outwardly from the central portion, the dielectric resonator body comprising an "X" shape defining a tilt angle $\gamma$ between two arms of the dielectric resonator body, wherein the tilt angle $\gamma$ ranges from about 66 degrees to about 83 degrees, such that the smaller the tilt angle $\gamma$, the higher the coupling factor K12; and an input conductive member in the cavity, wherein the input conductive member is disposed proximate the TM dual-mode resonator for coupling between the input conductive member and the TM dual-mode resonator.

In one version, the dielectric resonator body is oriented in the cavity by an orientation angle relative to a centred point in the cavity whereby said arms of the dielectric resonator body are rotated around the centred point such that the arms are kept as far away as possible from the cavity surfaces to increase Q-value. A first arm of the dielectric resonator body is oriented in the cavity by an orientation angle $\phi$ relative to the input conductive member; and a second arm of the dielectric resonator body, adjacent to the first arm, is oriented in the cavity by an orientation angle $\theta$ relative to the input conductive member, such that the orientation angles $\theta$ and $\phi$ sets the total angle $\gamma$ between the first and second arms.

The coupling Qe2 between the second arm and the input conductive member depends on the angle $\theta$, wherein the coupling Qe2 is dependent on the angle $\theta$. The coupling Qe1 between the first arm and the input conductive member depends on the angle $\phi$, wherein the coupling Qe1 is dependent on the angle $\phi$. The orientation angle $\theta$ can range from about 59 degrees to about 67 degrees. The orientation angle $\phi$ ranges from about 0 degrees to about 14 degrees.

In another version, the dielectric resonator body is oriented in the cavity by an orientation angle relative to the input conductive member, whereby said arms of the dielectric resonator body are rotated in the cavity such that the arms are kept as far away as possible from the cavity surfaces to increase Q-value.

The input conductive member can have a tilt angle relative to the cavity surfaces, such that orientation angles of the input conductive member relative to the arms of the dielectric resonator body are functions of the tilt angle of the input conductive member. Changing the tilt angle affects said orientation angles, resulting in changes in coupling between the arms and the input conductive member.

These, and other embodiments, features and advantages of the present invention will be apparent from the following specification taken in conjunction with the drawings.

BRIEF DESCRIPTION OF THE DRAWINGS

FIG. 1A is a partially broken-away perspective view of a filter including two cavities, each cavity housing a transverse magnetic (TM) dual mode resonator, according to an embodiment of the present invention.

FIG. 1B shows a perspective view of the interior filter of FIG. 1A, which includes four resonators forming the two TM dual mode resonators.

FIG. 1C shows details of a input pin spacing relative to a TM dual mode resonator in a cavity of the filter of FIG. 1A, according to an embodiment of the present invention.

DETAILED DESCRIPTION OF THE INVENTION

Figure 2:
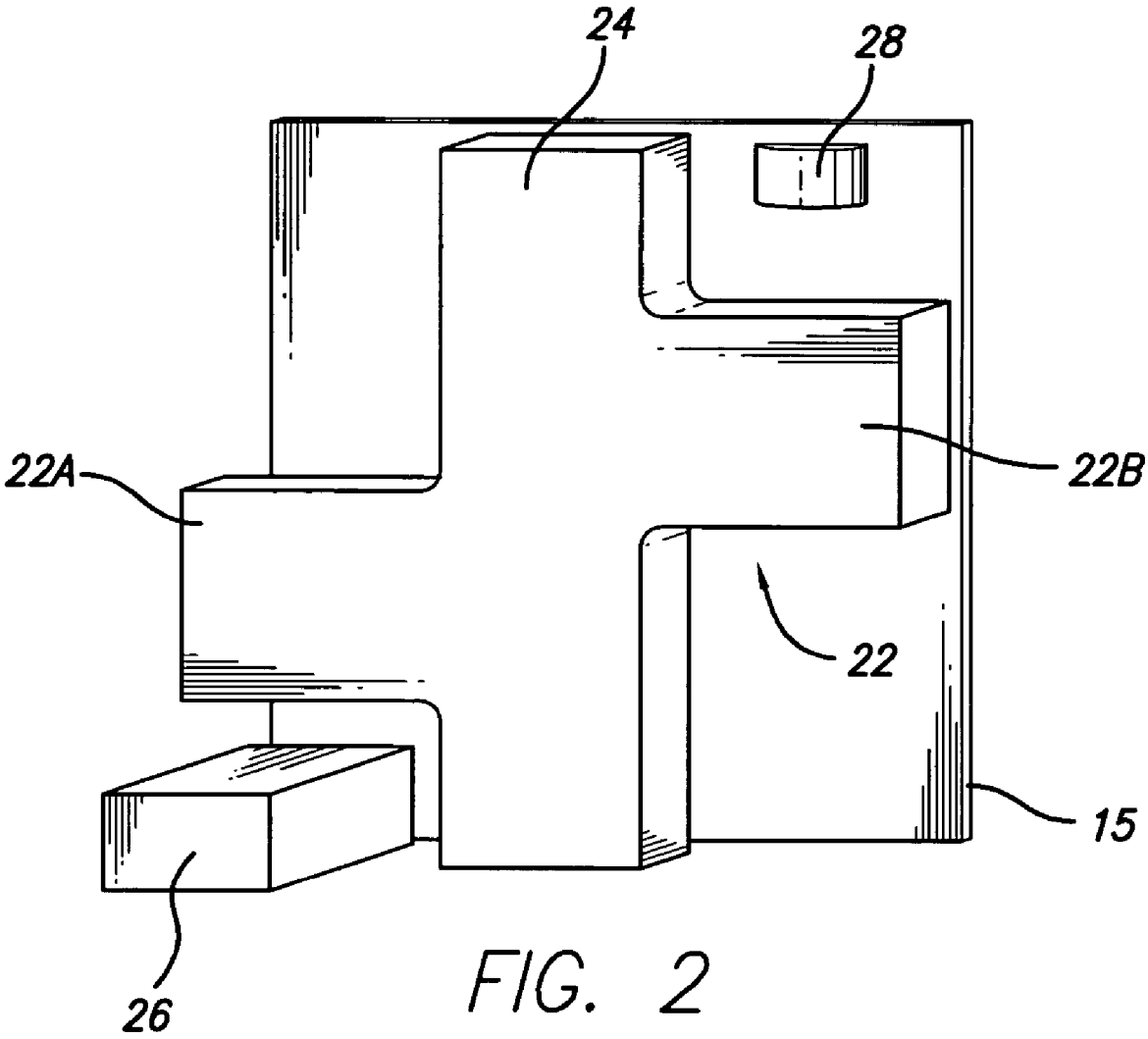
FIG. 2 shows a perspective view of interior of a cavity in another filter including a TM dual mode resonator with offset arms, according to an embodiment of the present invention.

The present invention provides a structure for smaller base station filters. Specific embodiments and various features and aspects of the invention are described below.

FIG. 1A is a partially broken-away perspective view of a filter 10 having a rectangular-shaped metal case 12, according to an embodiment of the present invention. FIG. 1B shows a perspective view of the interior of the filter of 10 FIG. 1A, providing two cavities (i.e., 14A, 14B) separated by a wall 15, wherein each cavity houses a transverse magnetic (TM) dual mode resonator. A first TM dual mode resonator 16 is formed by resonator members 16A, 16B crossing each other at a mid-point to form a "cross" or "X" in cavity 14A. A second TM dual mode resonator 18 is formed by resonator members 19A, 19B crossing each other at a mid-point to form as a "cross" or "X" in cavity 14B. The filter case 12 further houses input pins (i.e., 18A, 18B) coupled to coaxial connectors (i.e., 20A, 20B). In this structure, there is coupling between the input pin 18A and the resonators 16A, 16B. Similarly, there is coupling between the input pin 18B and the resonators 19A, 19B. The resonators comprise low loss dielectric material such as e.g. ceramics. Other materials can also be used.

The example filter 10 operates in the frequency range 1920-1980 MHz with four resonators (two cavities). Further, Table 1 below provides additional specifics:

TABLE 1

| | |
|---|---|
| K12 = 0.0333 | f = 65.0 MHz |
| K23 = 0.0245 | f = 47.7 MHz |
| K12 = 0.0333 | f = 65.0 MHz |

In Table 1, f represents frequency, and K12, K23 represent resonance modes coupling coefficients for different frequencies. In addition, the coupling Qe from input pin to a resonator mode is about 23 at f=84.4 MHz.

In this example, the filter structure has a height and width of about 26 mm, represented by simulated performance data discussed further below. Smaller dimensions may also be provided, for example the size 22 mm may be preferred. All tuning is preferably from the same direction.

FIG. 1C shows details of input pin 18A spacing relative to a TM dual mode resonator formed by resonators 16A, 16B in the cavity 14A of the filter 10 of FIG. 1B. In this example, the input pin 18A is a 5 mm input metal pin, and coupling to the input pin 18A depends on the Gap distance between the ceramic resonators 16A, 16B and the input pin 18A, as shown by example in Table 2 below.

TABLE 2

| Gap | fA | Qe |
|---|---|---|
| 4 | 1914 | 21 |
| 4.5 | 1904 | 24 |
| 5 | 1893 | 27 |
| 5.5 | 1883 | 31 |

One approach is to use a screw or a step in the corner. However, this embodiment uses a step 26 to preset the coupling and a screw 28 for fine-tuning.

FIG. 2 shows a perspective view of interior of cavity 20 in another filter including a TM dual mode resonator formed by resonators 22 and 24, wherein the resonator 22 has offset arms 22A and 22B, according to an embodiment of the present invention. The arms 22A and 22B are offset to contribute to the coupling between the two resonators by rotating the field to less orthogonality. In that case there is less metal in the cavity, which means better Q-value. This embodiment uses a step 26 to preset the coupling and a screw 28 for fine-tuning.

Figure 3A:
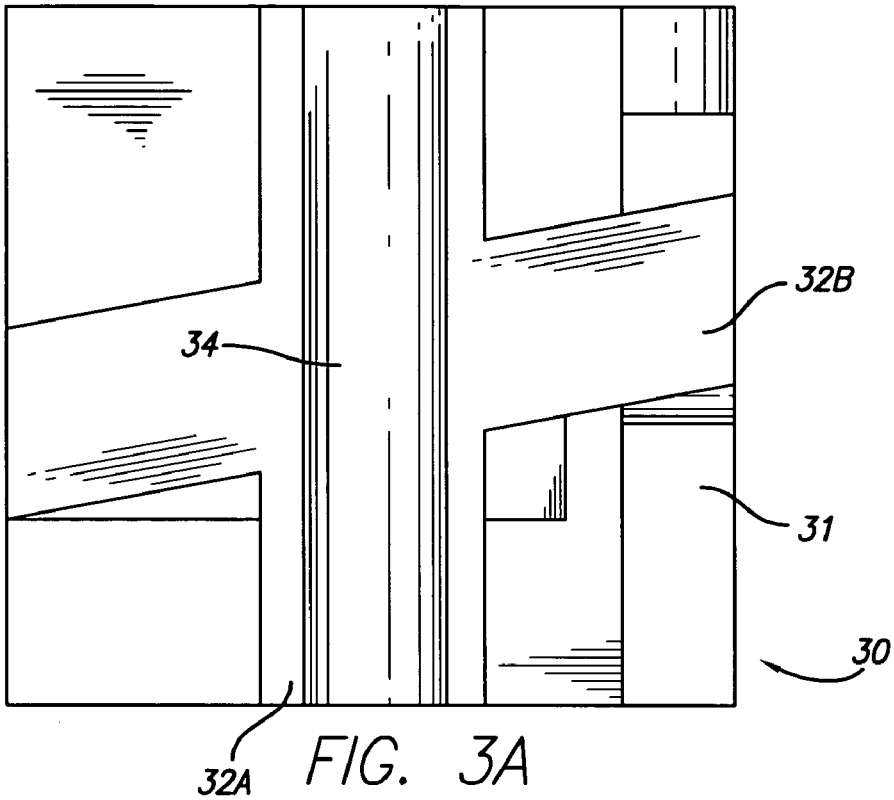
FIG. 3A shows a side view of the interior of a cavity in another filter including a TM dual mode resonator with tilted arms, according to an embodiment of the present invention.
Figure 3B:
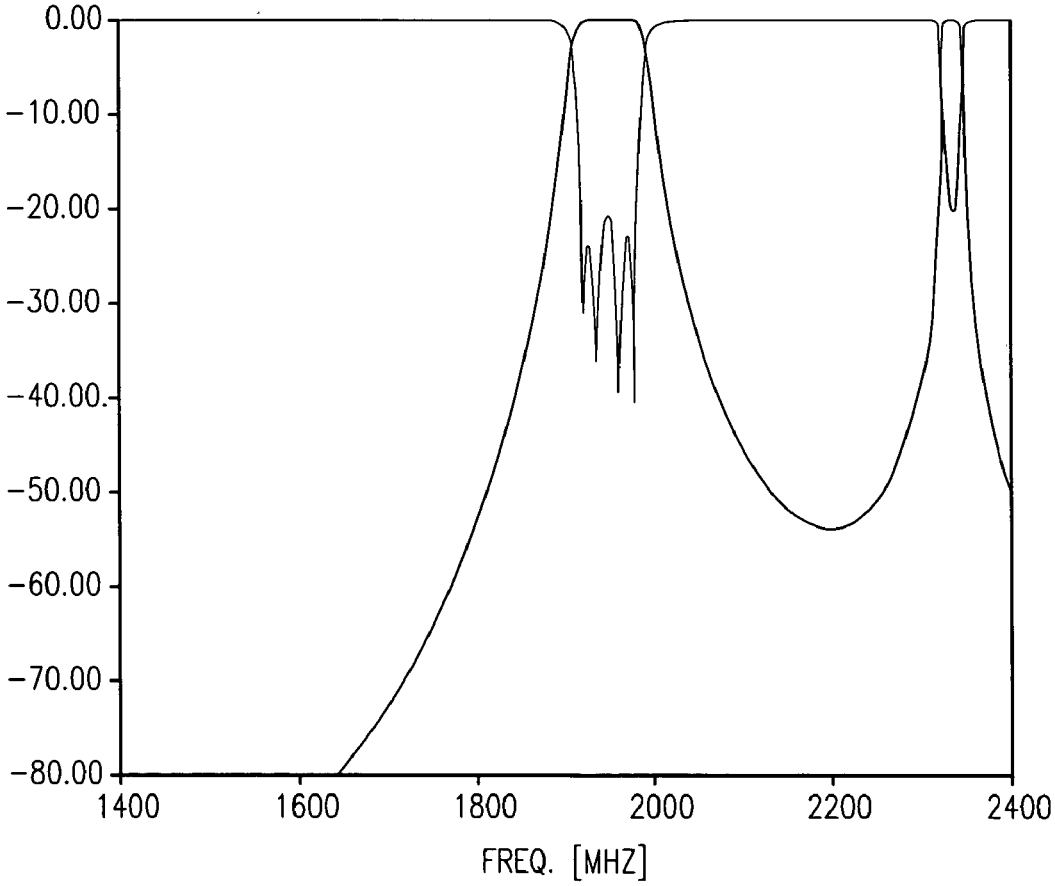
FIG. 3B is a graph showing an example frequency response of the filter of FIG. 3A.

FIG. 3A shows a side view of the interior of a cavity 31 in another filter 30 including a TM dual mode resonator formed by resonators 32A, 32B wherein the resonators 32A, 32B are tilted with respect to one another to form an "X", according to an embodiment of the present invention. The input pin 34 is also shown in FIG. 3A. With tilted resonators (arms) there is harder coupling between the pin 34 and resonator modes. As described further below, the coupling depends on the tilt angle between the two resonators 32A, 32B. A square step in the lower corner is no longer needed. FIG. 3B is a graph showing an example frequency response of the filter of FIG. 3A.

Figure 4A:
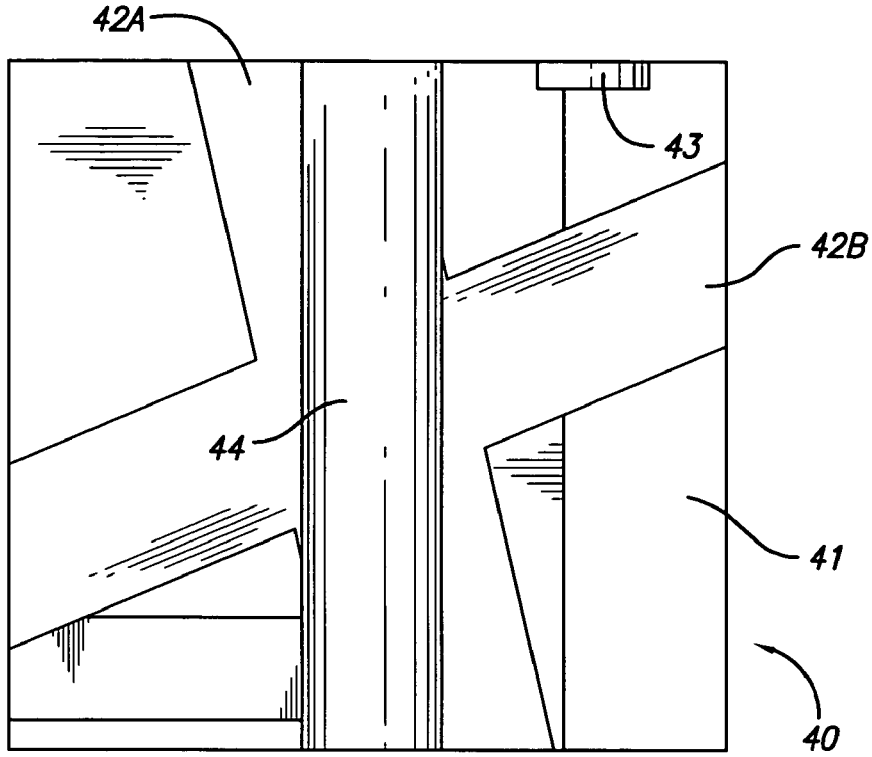
FIG. 4A shows a side view of the interior of a cavity in another filter a including TM dual mode resonator, cross tilted up, according to an embodiment of the present invention.
Figure 4B:
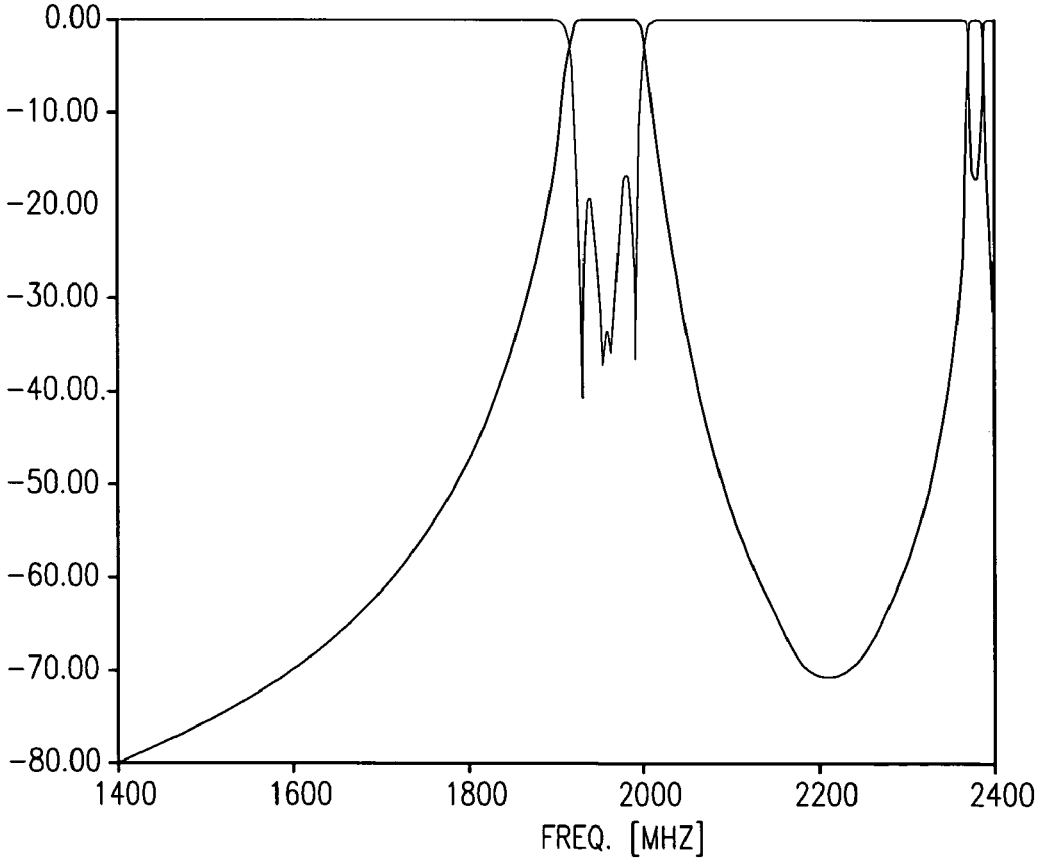
FIG. 4B is a graph showing an example frequency response of the filter of FIG. 4A.

FIG. 4A shows a side view of the interior of a cavity 41 in another filter 40 including a TM dual mode resonator formed by resonators 42A, 42B wherein the resonators 42A, 42B form a "cross" or "X" that is tilted up in the cavity 41, according to another embodiment of the present invention. The input pin 44 is also shown in FIG. 4A. FIG. 4B is a graph showing an example frequency response of the filter of FIG. 4A.

Figure 6:
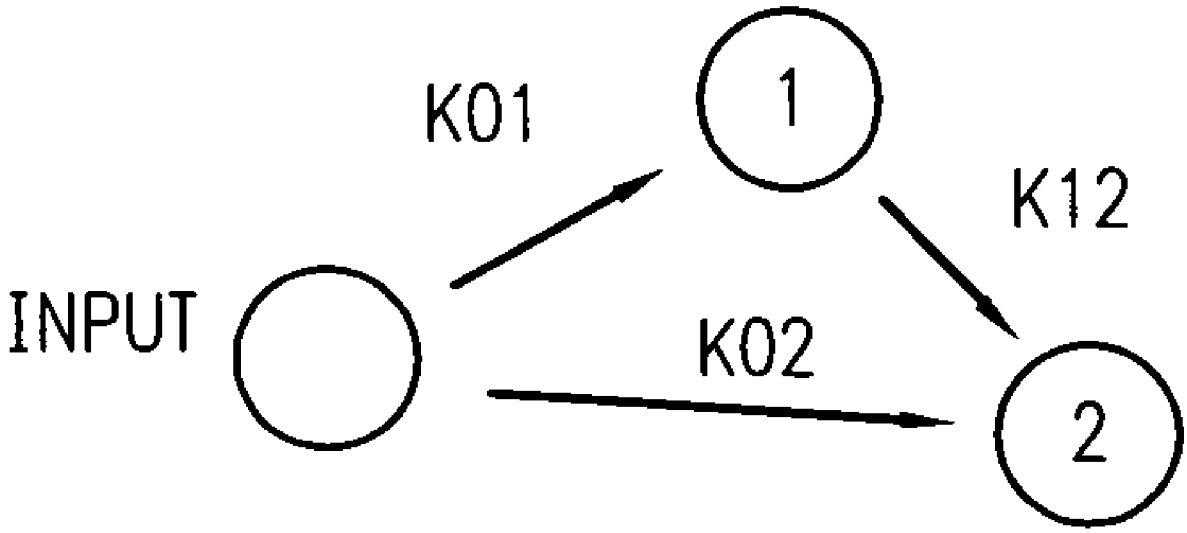
FIG. 6 is a diagram shown an example coupling transmission zero for a filter including TM dual mode resonators, according to an embodiment of the present invention.

Referring back to FIG. 4A, the entire TM dual mode resonator "cross" or "X" is turned (tilted) slightly, so that the input can couple to the second mode as well. This additional coupling creates a zero in transmission on the higher side of the spectrum, wherein as schematically shown by example in FIG. 6:

Coupling k02→Transmission zero at high side

Harder coupling→Zero at lower frequency

Figure 9:
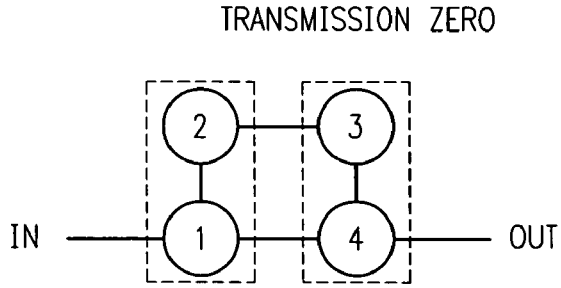
FIG. 9 is a diagram shown an example coupling transmission zero for a filter including TM dual mode resonators, according to an embodiment of the present invention.

FIG. 9 is a diagram shown an example coupling transmission zero for a filter including TM dual mode resonators, according to an embodiment of the present invention, wherein:

Coupling a quadruple with the right phase shift→Two zeroes

Figure 5A:
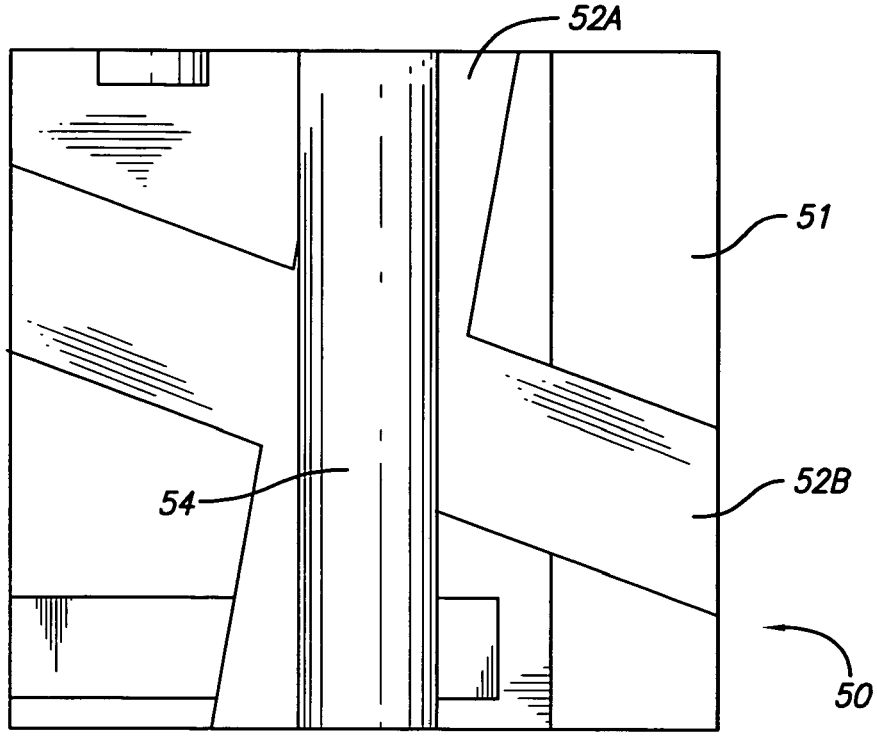
FIG. 5A shows another filter including a TM dual mode resonator, cross tilted down, according to an embodiment of the present invention.
Figure 5B:
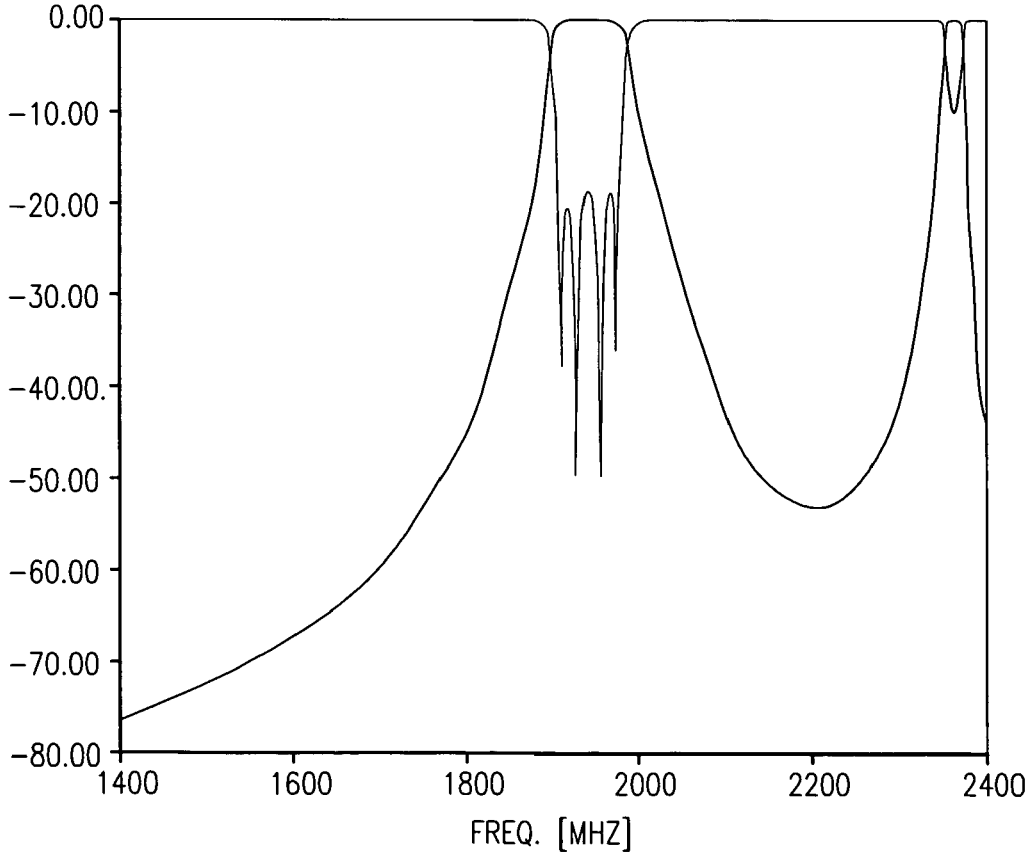
FIG. 5B is a graph showing an example frequency response of the filter of FIG. 5A.

FIG. 5A shows a side view of the interior of a cavity 51 in another filter 50 including a TM dual mode resonator formed by resonators 52A, 52B wherein the resonators 52A, 52B form a "cross" or "X" that is tilted down in the cavity 51, according to an embodiment of the present invention. The input pin 54 is also shown in FIG. 5A. The entire TM dual mode resonator cross (or X) is turned (tilted) slightly, so that the input can couple to the second mode as well. As in FIG. 4A, the tilted cross (or X) results in a better attenuation on the higher side of the spectrum. FIG. 5B is a graph showing an example frequency response of the filter of FIG. 5A.

Figure 7A:
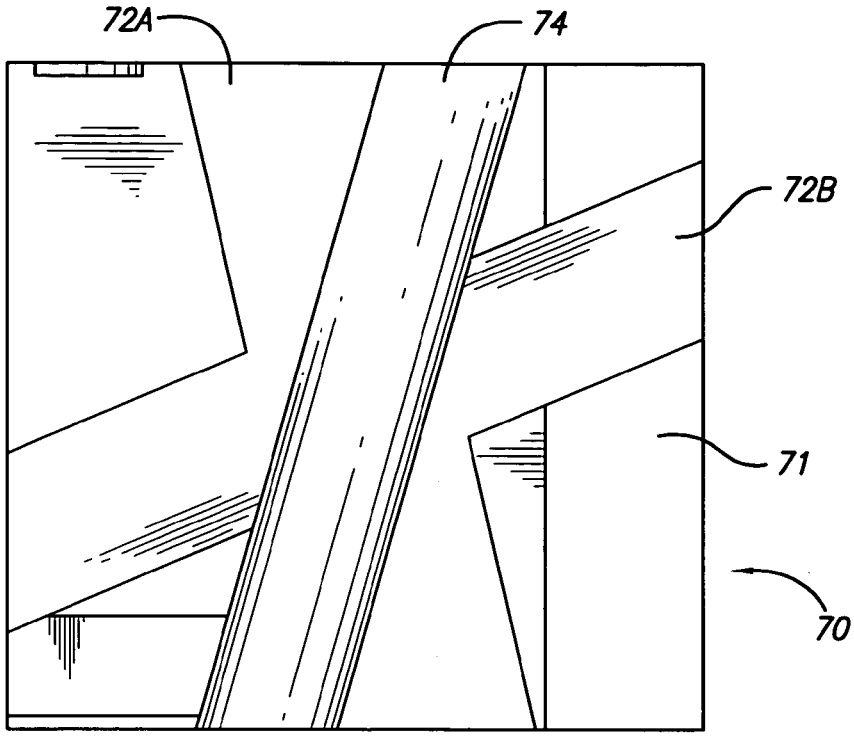
FIG. 7A shows another filter including a TM dual mode resonator with tilted input, according to an embodiment of the present invention.
Figure 7B:
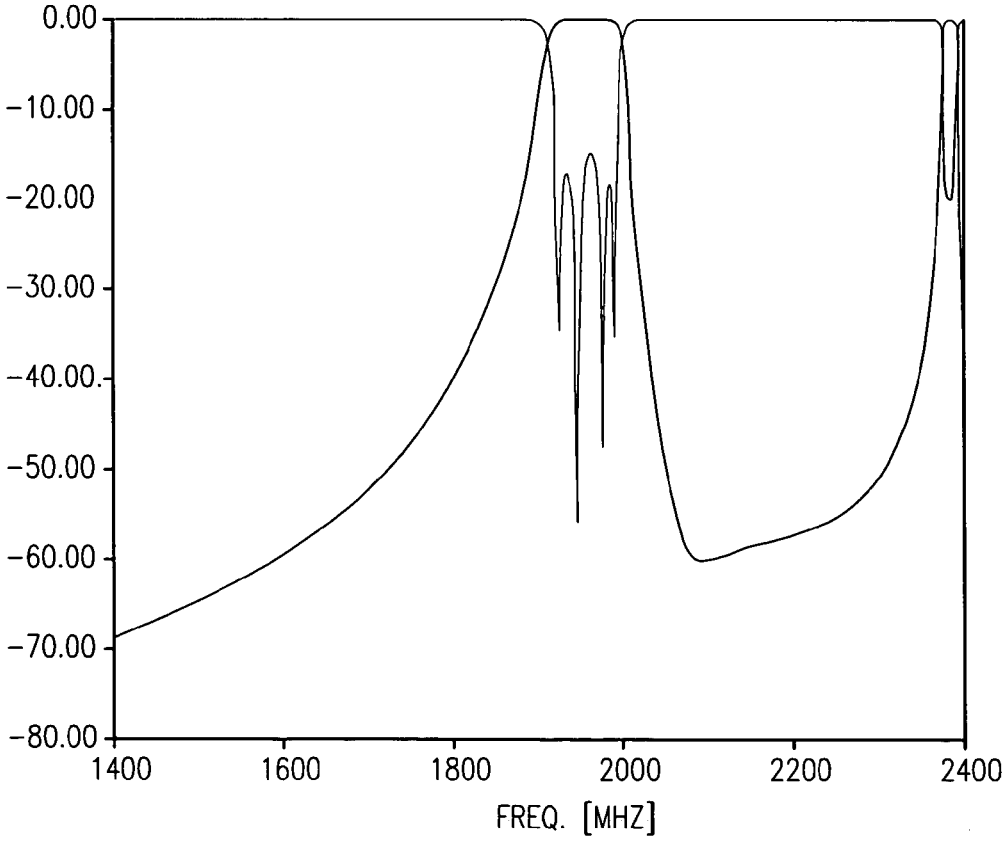
FIG. 7B is a graph showing an example frequency response of the filter of FIG. 7A.

FIG. 7A shows a side view of the interior of a cavity 71 in another filter 70 including a TM dual mode resonator formed by resonators 72A, 72B which form a "cross" or "X" that is tilted down in the cavity 71, according to an embodiment of the present invention. The input pin 74 is also shown in FIG. 7A. The entire TM dual mode resonator cross (or X) is turned (tilted) slightly, and the input pin 74 is tilted relative to the resonators 72A, 72B. With a tilted input pin 74, the coupling to mode 2 can be harder. In this way the transmission zero can be placed in the filter skirt very close to the passband. FIG. 7B is a graph showing an example frequency response of the filter of FIG. 7A. In FIG. 7B, the notch placed on the high side is very wide, and deep, with −60 dB as close as 2100 MHz.

Figure 8:
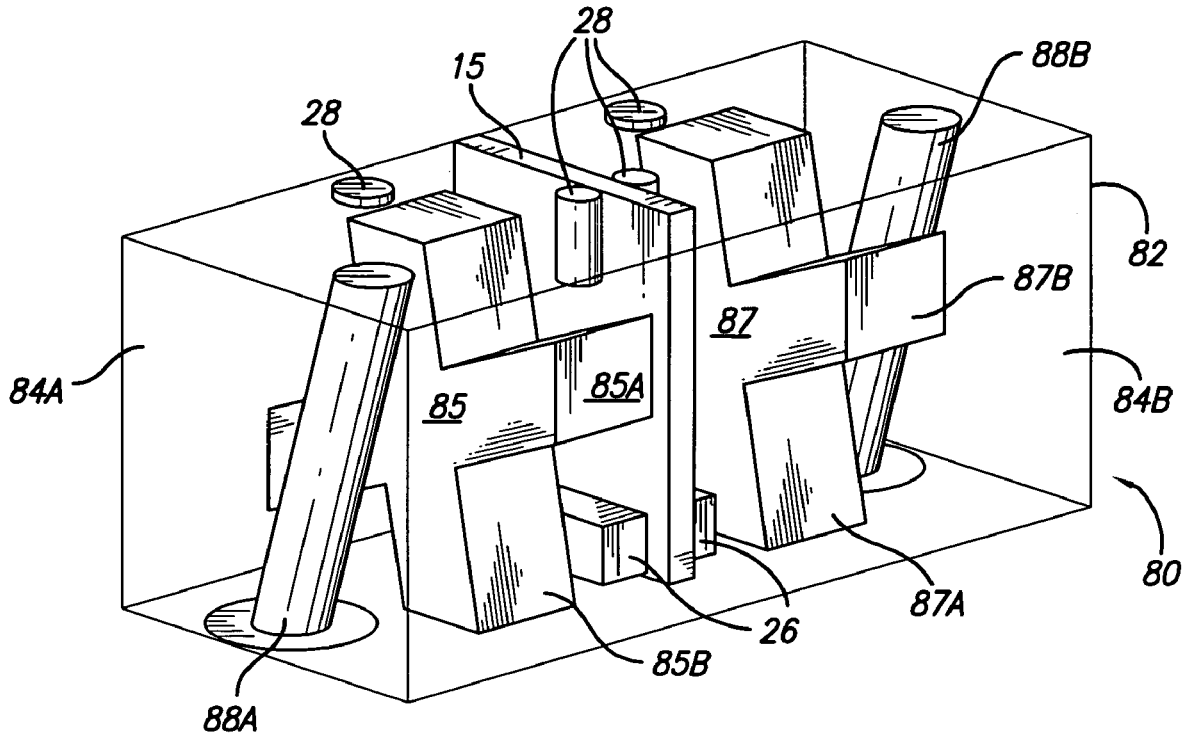
FIG. 8 shows a perspective view of a filter including two cavities, each cavity housing a TM dual mode resonator with tilted input, according to an embodiment of the present invention.

FIG. 8 shows a perspective view of a filter 80 including a case 82 that forms two cavities 84A, 84B, which is a dual cavity implementation the example in FIG. 7A, according to an embodiment of the present invention. In FIG. 8, the cavity 84A houses the tilted input pin 88A and a first TM dual mode resonator 85 formed by resonators 85A, 85B as a "cross" or "X". The cavity 84B houses the tilted input pin 88B and a second TM dual mode resonator 87 formed by resonators 87A, 87B as a "cross" or "X".

Figure 10A:
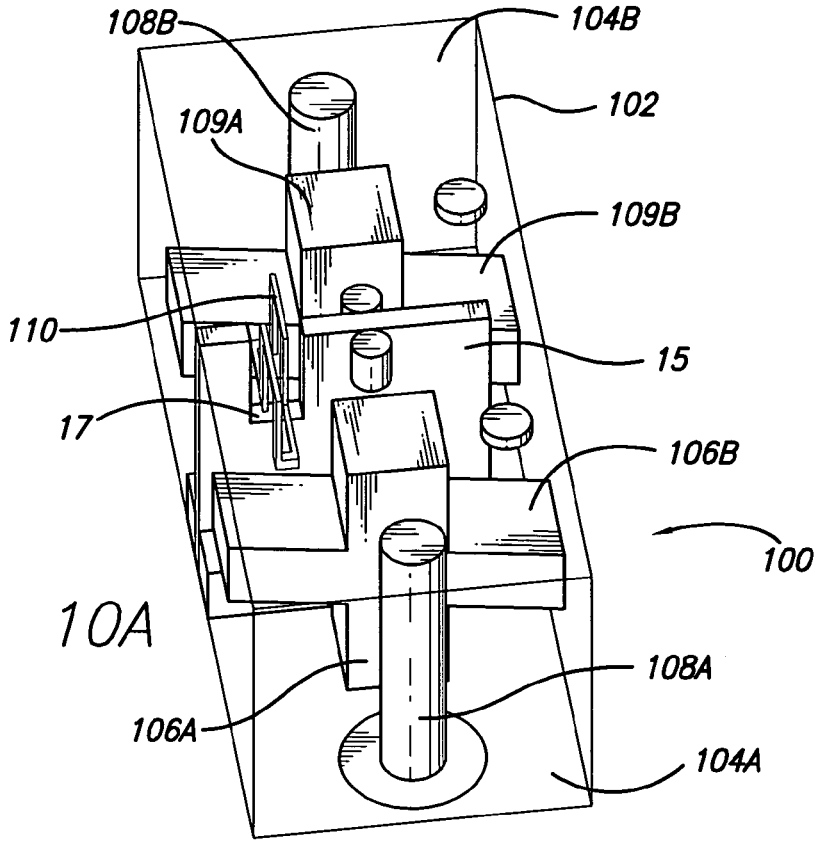
FIG. 10A is a perspective view of a filter including two cavities, each cavity housing a TM dual mode resonator, with loop coupling between resonator modes 1 and 4, according to an embodiment of the present invention.

FIG. 10A is a perspective view of a filter 100 having a case 102 that provides two cavities 104A and 104B, according to an embodiment of the present invention. The cavity 104A houses input pin 108A and a TM dual mode resonator formed by resonators 106A, 106B as a "cross" or "X". The cavity 104B houses input pin 108B and a TM dual mode resonator formed by resonators 109A, 109B as a "cross" or "X". Further, there is a loop 110 passing through an opening 17 in wall 15 between the two cavities 104A and 104B, providing coupling between resonator modes 1 and 4.

Figure 10B:
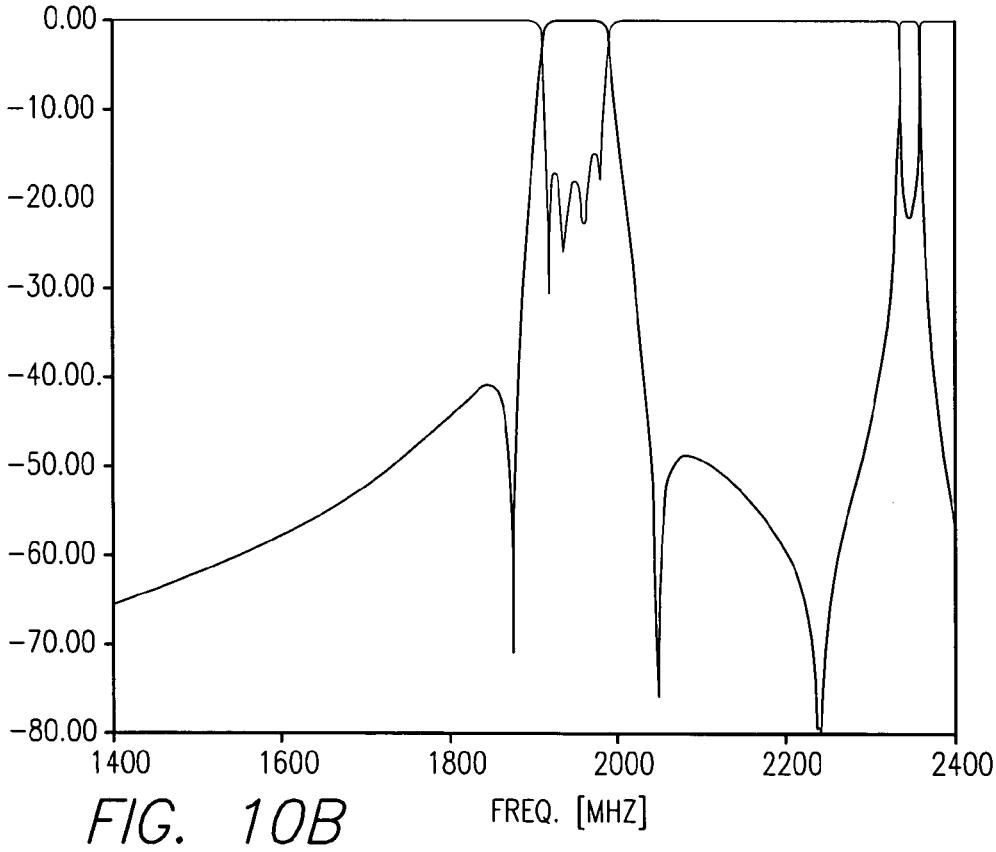
FIG. 10B is a graph showing an example frequency response of the filter of FIG. 10A.

Coupling is accomplished with a closed loop coupling 110, which need not be connected to the cavity walls. The loop 110 is twisted in the form of a laying figure "8" for proper phase of the coupling. The loop 110 can for example be printed on a double-sided substrate card (e.g., Teflon substrate). Loops with different widths provide different position of the transmission zeroes. FIG. 10B is a graph showing an example frequency response of the filter of FIG. 10A.

Figure 11A:
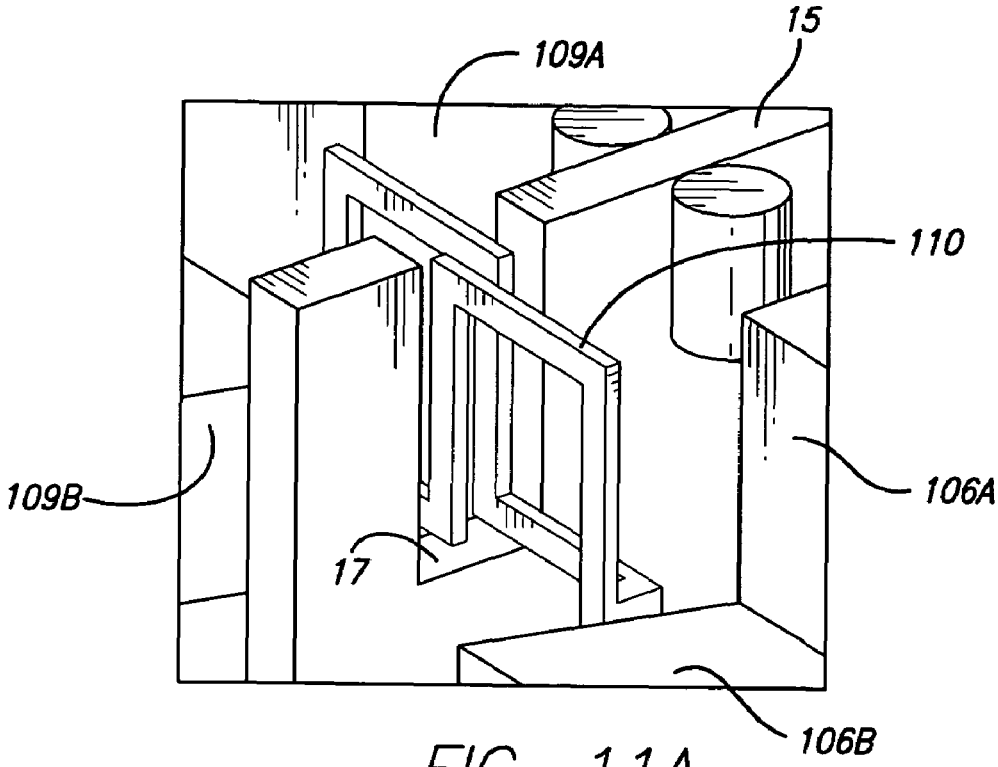
FIG. 11A is a detail perspective view of the cross coupling in the filter of FIG. 10A.
Figure 11B:
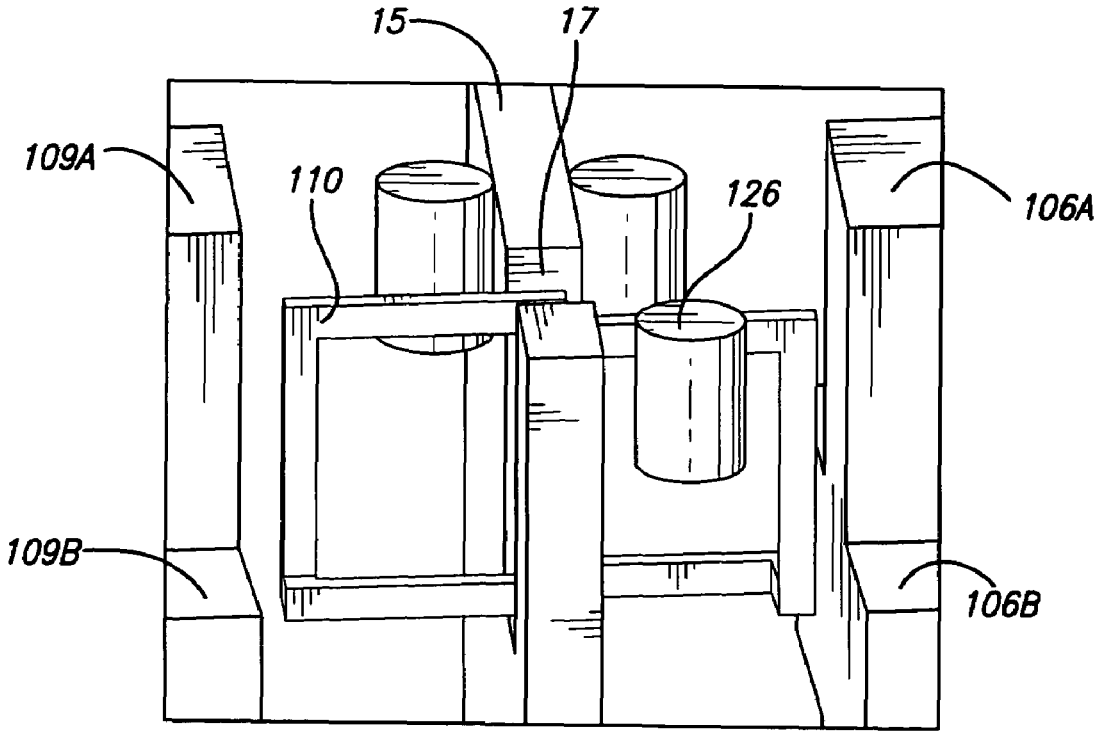
FIG. 11B is a detail side view of the cross coupling in the filter of FIG. 10A.

Coupling with a quadruple can make double transmission zeroes very close to the passband. FIG. 11A is a detail perspective view of the cross-coupling 110 in the filter of FIG. 10A. FIG. 11B is a detail side view of the cross-coupling 110 in the filter of FIG. 10A. Fine tuning can be performed with a screw 126 that blocks the loop 110.

Figure 12A:
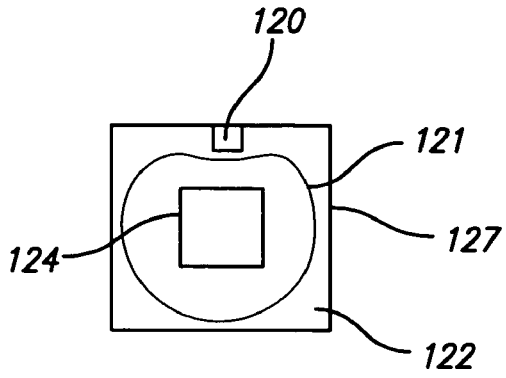
FIG. 12A shows an example magnetic field diagram for tuning frequency, influenced by a metal along the side of a filter cavity which including TM dual mode resonators, according to an embodiment of the present invention.
Figure 12B:
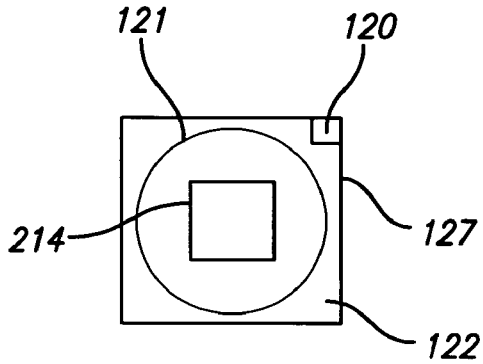
FIG. 12B shows an example magnetic field diagram for tuning frequency, influenced by a metal along a corner of a filter cavity which including TM dual mode resonators, according to an embodiment of the present invention.

FIG. 12A shows a top view of an example magnetic field 121 for tuning frequency, influenced by a metal 120 along the side of a filter cavity 122 which houses a TM dual mode resonator 124, according to an embodiment of the present invention. FIG. 12B shows the magnetic field 121, influenced by a metal 120 along a corner of the filter cavity 122. The magnetic fields is influenced by a metal along the side, wherein the frequency is changed as a result. In the corner there is less influence i.e. less changes. A screw into the cavity will influence the field in the same way. Deeper penetration influences more of the field.

Figure 13:
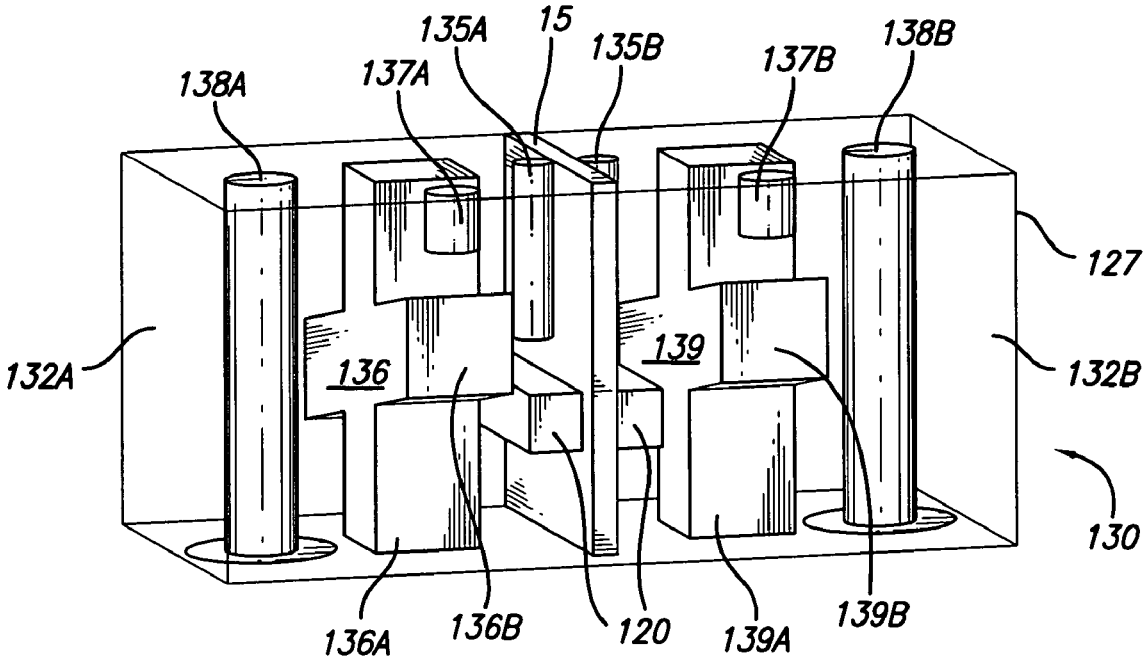
FIG. 13 shows perspective view of a filter including two cavities, each cavity housing a TM dual mode resonator, and metals in the cavities for tuning frequency, according to an embodiment of the present invention.

FIG. 13 shows perspective view of a filter 130 with a casing 127, implementing two a cavity (132A, 132B) version of the examples in FIGS. 12A and 12B. The cavity 132A houses input pin 138A and a TM dual mode resonator formed by resonators 136A, 136B as a "cross" or "X". The cavity 132B houses input pin 138B and a TM dual mode resonator formed by resonators 139A, 139B as a "cross" or "X".

To tune electric fields there have to be holes in the ceramic resonators 136, 139 in two orthogonal directions. This embodiment instead tunes the magnetic fields 121 (FIGS. 12A-B) close to the cavity walls 127. In each cavity, resonance modes 1 and 4 are easily tuned with a screw (e.g., 137A or 137B; 135A or 135B) from the top. Modes 2 and 3 are tuned with a metal bar 120 that is moved from the bottom and up. The bar can be moved with a screw from the top, placed in the corner. To prevent the moving bars from generating PIM the moving parts can be covered with a thin dielectric film.

Figure 14:
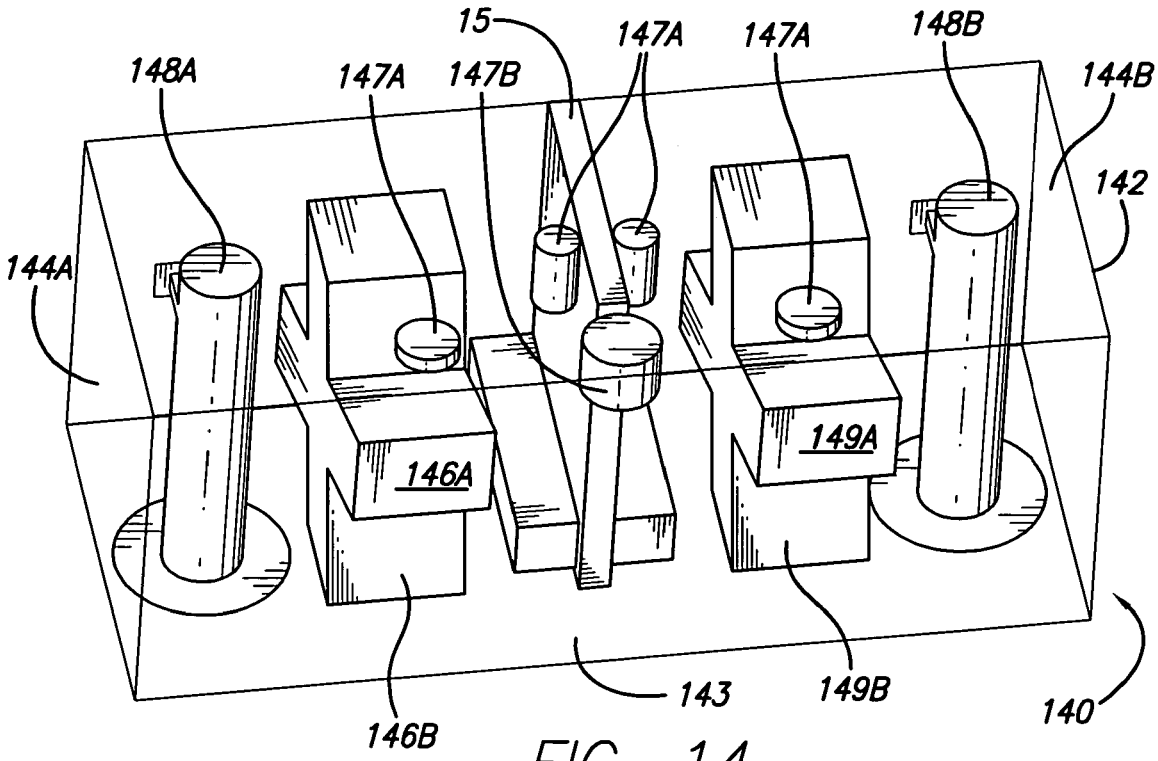
FIG. 14 shows perspective view of a filter including two cavities, each cavity housing a TM dual mode resonator, and metals in the cavities for tuning couplings, according to an embodiment of the present invention.

FIG. 14 shows perspective view of a filter 140 with a case 142 providing two cavities 144A and 144B, according to an embodiment of the present invention. The cavity 144A houses input pin 148A and a TM dual mode resonator formed by resonators 146A, 146B as a "cross" or "X". The cavity 144B houses input pin 148B and a TM dual mode resonator formed by resonators 149A , 149B as a "cross" or "X". Metals in the cavities 144A and 144B are for tuning couplings. Coupling between modes 1-2 and 3-4 can be done with screws 147A from the top. Coupling of the modes 3-4 is done in the aperture opening 143 in the separating wall. Even this coupling can be done with a screw 147B from the top, placed in the opening 143. In the tilt up case (FIG. 4A) there may be a 4 mm long screw 43 with diameter of 6 mm, or a 10 mm long screw with 5 mm diameter, to get a shift of 10 MHz in k23.

Figure 15A:
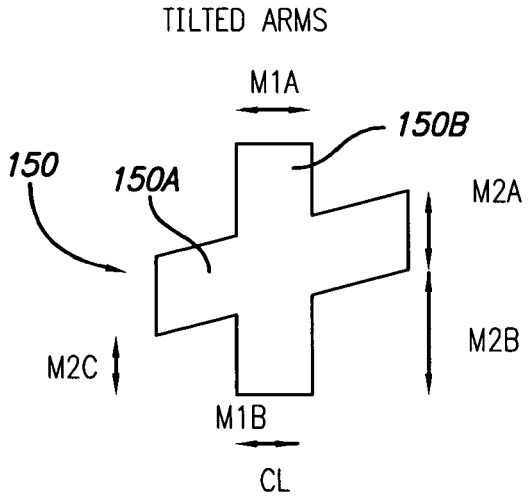
FIG. 15A shows example diagram of frequency tuning based on dimensions of a ceramic filter with a TM dual mode resonator having tilted arms, according to an embodiment of the present invention.
Figure 15B:
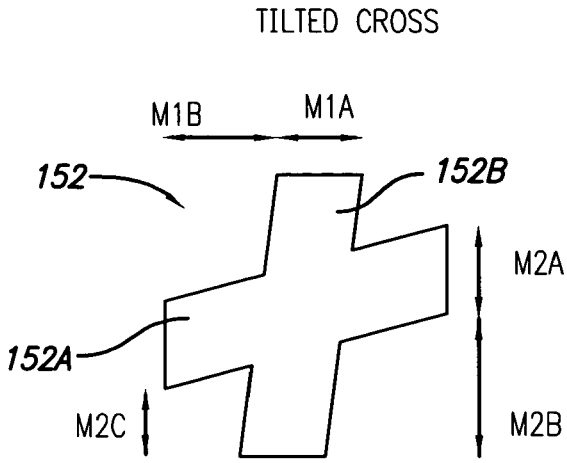
FIG. 15B shows example diagram of frequency tuning based on dimensions of a ceramic filter having a TM dual mode resonator with tilted cross, according to an embodiment of the present invention.

FIG. 15A shows example diagram of frequency tuning based on dimensions of a ceramic filter including a TM dual mode resonator 150 formed by resonators 150A, 150B as a "cross" or "X" having tilted arms, according to an embodiment of the present invention. FIG. 15B shows example diagram of frequency tuning based on dimensions of a ceramic filter having a TM dual mode resonator 152 formed by resonators 152A, 152B with tilted "cross" or "X", according to an embodiment of the present invention.

Referring to the example in Table 3 below, the frequencies and the coupling between the modes are dependent on the dimensions of the ceramic resonators (150A, 150B in FIG. 15A, and 152A, 152B in FIG. 15B).

TABLE 3

| Dimensions | Primary | Secondary |
|---|---|---|
| M1A | f1 | K12 |
| M1B | K12 | f1 |
| M2A | f2 | f1 |

TABLE 3-continued

| Dimensions | Primary | Secondary |
|---|---|---|
| M2B | K12 | f2 |
| Gap | Qe | f1 |
| Wall | K23 | f2 |

As is known by those skilled in the art, in Table 3 the terms f1, f2, etc., represent resonance frequencies of first, second, etc., resonance modes, and the terms K0, K1, K12, K23, etc., represent resonance modes coupling coefficients.

In Table 3 "Gap" is the distance between the ceramic resonators and the metal pins of the input, and "Wall" is the width of the separating wall 15 between the cavities. The dimensions M1A, M1B, M2A, M2B, are shown in FIGS. 15A-B. The frequencies have the strongest dependence, wherein a change of 0.1 mm in dimensions can result in 10 MHz offset.

The filter may be first tuned with these dimensions to obtain a design centering. Then, when the filter is produced simpler tuning with the tuning screws can be performed.

The finished filter has only one small secondary effect in the tuning screws. Tuning of f1 will make a shift in K12 a few MHz. Table 4 below shows the difference in MHz when the screw for f1 changes 12 mm, and the bar for f2 changed 8 mm. K12 is changed with a 3 mm screw on the right and on the left side of the resonators.

TABLE 4

| | Tilted arms | Tilt up | Tilt down |
|---|---|---|---|
| f1 | 24 | 20 | 20 |
| f2 | 49 | 33 | 26 |
| K12 | 21 | 15 | 16 |

Figure 16A:
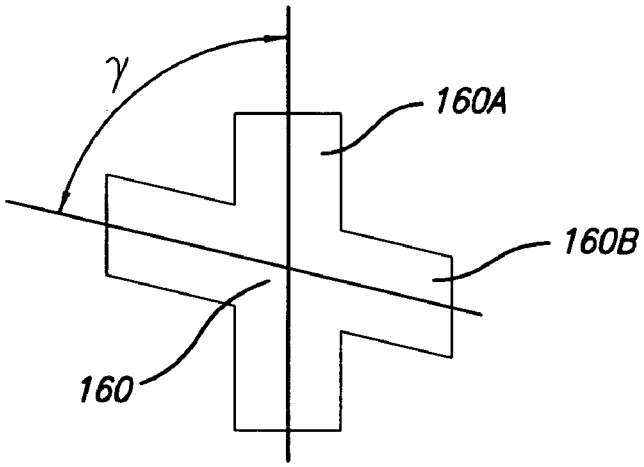
FIG. 16A is an example diagram showing effect of tilt angle between resonators forming a TM dual mode resonator, in a filter cavity, according to an embodiment of the present invention.

FIG. 16A is an example diagram showing effect of tilt angle γ between resonators 160A, 160B forming a TM dual mode resonator 160 as a "cross" or "X", in a filter cavity, according to an embodiment of the present invention. As shown by example in Table 5 below, the angle γ between the two resonators 160A, 160B sets the coupling factor (coefficient) K12 between the two modes. With orthogonal fields (γ=90°) there will be no coupling. With angle γ<90° there will be a certain coupling. The more the two resonators 160A, 160B are aligned, the higher the coupling.

TABLE 5

| Angle γ | K12 |
|---|---|
| 66.3 | 0.0806 |
| 70.1 | 0.0598 |
| 74.1 | 0.0416 |
| 78.3 | 0.0265 |
| 82.5 | 0.0215 |

Figure 16B:
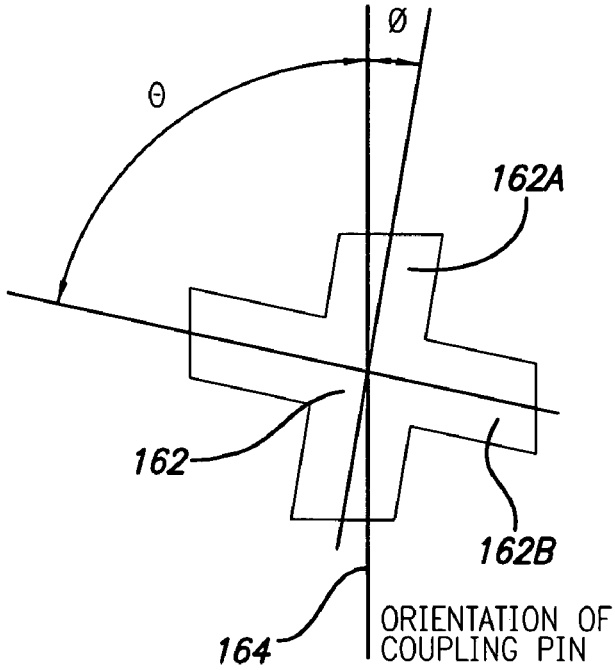
FIG. 16B is an example diagram showing effect of angles between resonators forming a TM dual mode resonator and orientation of input coupling pin, in a filter cavity, according to an embodiment of the present invention.

FIG. 16B is an example diagram showing effect of angles between resonators 162A, 162B forming a TM dual mode resonator 162 as a "cross" or "X", and orientation of input coupling pin 164, in a filter cavity, according to an embodiment of the present invention. When the arms, or the whole "cross" or "X" are tilted by an orientation angle ϕ, the resonators 162A, 162B are rotated around a centred point in the cavity. In this way the resonators 162A, 162B are kept as far away as possible from the walls of the cavity, and the Q-value will be high. Tables 6-7 below show effect of angle θ, and the orientation angle ϕ of the coupling pin 164 relative to the resonators 162A, 162B. Angle θ affects the coupling since it, together with angle ϕ, sets the total angle γ between resonators 162A and 162B.

TABLE 6

| Angle θ | K12 | Qe2 |
|---|---|---|
| 59.4 | 0.0683 | 224 |
| 62.7 | 0.0438 | 282 |
| 66.3 | 0.0267 | 387 |

TABLE 7

| Angle ϕ | Qe1 |
|---|---|
| 0 | 25.7 |
| 4.4 | 25.1 |
| 8.7 | 26.0 |
| 13.0 | 26.9 |

Qe1 is the coupling from input pin 164 to resonator mode 1, and Qe2 is the coupling between input pin 164 and resonator mode 2. The Qe2 coupling depends on the angle θ. A smaller angle θ results in harder coupling from the input to mode 2, which results in a transmission zero at the higher side of the spectrum.

The total angle γ=θ+ϕ is chosen for the proper K12, and the tilt angle ϕ of the "cross" or "X" is chosen to obtain the proper Qe2. Even Qe1 is affected by the angle ϕ. However, this small change in Qe1 can be corrected with the distance between input pin and the resonator cross (or X). The value of Qe1 at ϕ=θ is a result of the metal screws in the cavity.

Figure 17:
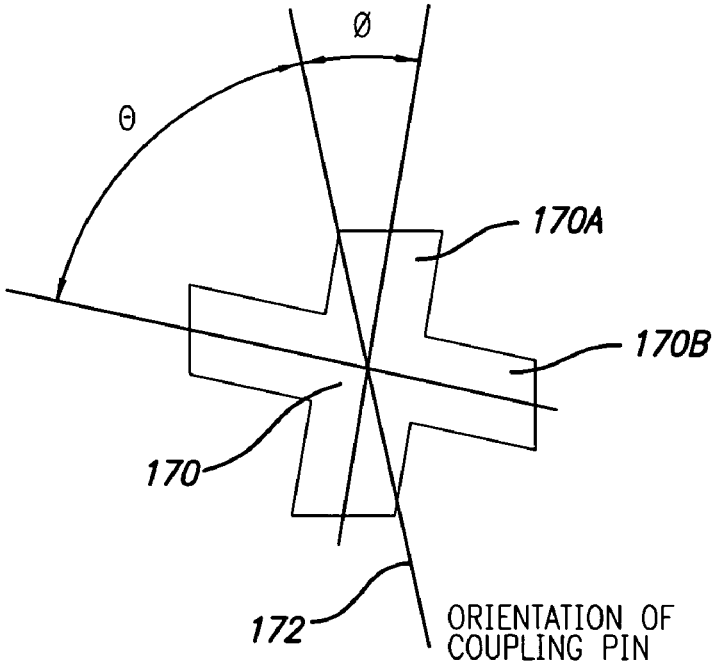
FIG. 17 is an example diagram showing effect of angles between resonators forming a TM dual mode resonator, and tilt of input coupling pin, in a filter cavity, according to an embodiment of the present invention.
Figure 18:
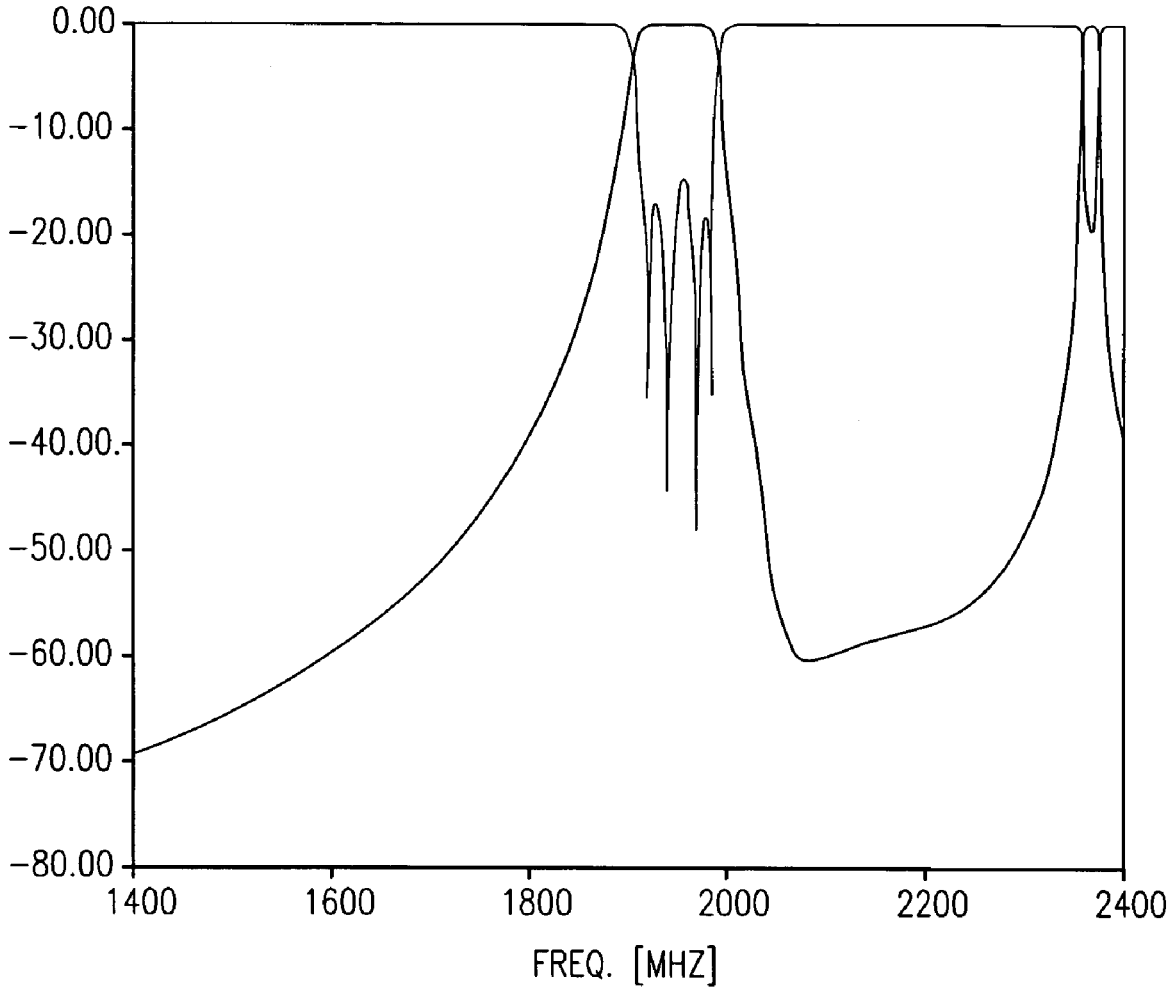
FIG. 18 is a graph showing an example frequency response of the filter of FIG. 17.

FIG. 17 is an example diagram showing effect of angles between resonators 170A, 170B forming a TM dual mode resonator 170 as a "cross" or "X", and tilt of input coupling pin 172, in a filter cavity, according to an embodiment of the present invention. Compared to FIG. 16B, by further tilting the input pin 172, the angle θ is decreased and the angle ϕ is increased. Angle ϕ at 26.7 degrees results in smaller coupling to mode 1 (higher Qe1). This was compensated, by moving the input pin closer to the "cross" or "X" formed by the resonators 170A, 170B. For angle θ=51.7 results in a coupling to mode 2 (Qe2=177) so high that the transmission zero is very close to the filters pass band. FIG. 18 is a graph showing an example frequency response of the filter of FIG. 17.

Simulations were performed in hfss. In one simulation, the filter structure included tuning screws and a coupling screw of 4 mm diameter with the length of 1 mm. The coupling screw is placed in the upper left corner of the cavity. All mechanical parts in the cavity will influence the fields and have to be included when performing design centring. The coupling can be set over a range wide enough to be used for base station filters.

The present invention has been described in considerable detail with reference to certain preferred versions thereof; however, other versions are possible. Therefore, the spirit and scope of the appended claims should not be limited to the description of the preferred versions contained herein.

What is claimed is:

1. A filter comprising:

an enclosure having a cavity;

a TM dual-mode resonator in the cavity, the TM dual-mode resonator having first and second modes and comprising a TM dielectric resonator body having a central portion with a plurality of arms extending outwardly from the central portion;

an input conductive member in the cavity, wherein the input conductive member is disposed proximate the TM dual-mode resonator for coupling between the input conductive member and the TM dual-mode; and at least one tuning member that is adjacent one or more of the plurality of arms, wherein all tuning is in the same direction.

2. The filter of claim 1 wherein the dielectric resonator body comprises a cross shape.

3. The filter of claim 1 further comprising a tuning member that is positioned adjacent one or more of the plurality of arms, for tuning a magnetic field in the cavity.

4. The filter of claim 1 wherein at least two of the arms are offset relative to the central portion of the dielectric resonator body.

5. The filter of claim 1 wherein the dielectric resonator body comprises an "X" shape.

6. The filter of claim 5 wherein:

the cavity is essentially rectangular with essentially parallel top and bottom surfaces, and one arm of said plurality of arms of the dielectric resonator body is transverse relative to said cavity surfaces.

7. The filter of claim 5 wherein two or more arms of said plurality of arms of the dielectric resonator body are transverse relative to said cavity surfaces.

8. The filter of claim 7 wherein a transmission zero is close to the bandpass of the filter.

9. The filter of claim 1 wherein:

the cavity is essentially rectangular with essentially back and front surfaces, and the input conductive member is transverse relative to said cavity surfaces.

10. The filter of claim 1 wherein:

the cavity is essentially rectangular with essentially parallel top and bottom surfaces, and essentially parallel front and back surfaces;

at least one arm of said plurality of arms of the dielectric resonator body is transverse relative to said cavity top and bottom surfaces; and the input conductive member is transverse relative to said top and bottom cavity surfaces.

11. The filter of claim 10 wherein the dielectric resonator body comprises an "X" shape.

12. A filter comprising:

an enclosure having a cavity;

a TM dual-mode resonator in the cavity, the TM dual-mode resonator having first and second modes and comprising a TM dielectric resonator body having a central portion with a plurality of arms extending outwardly from the central portion;

an input conductive member in the cavity, wherein the input conductive member is disposed proximate the TM dual-mode resonator for coupling between the input conductive member and the TM dual-mode resonator;

a first tuning member positioned proximate the dielectric resonator body in the cavity to preset the coupling; and a second tuning member positioned proximate the dielectric resonator body in the cavity for fine-tuning.

13. The filter of claim 12 wherein:

the first tuning member comprises a step in a corner of the cavity; and the second tuning member comprises a tuning screw.

14. The filter of claim 12 wherein the tuning members comprise metals covered with dielectric film.

15. A filter comprising:

an enclosure having two cavities separated by a wall;

two TM dual-mode resonators, each TM dual-mode resonator positioned in a corresponding cavity, each TM dual-mode resonator having first and second modes and comprising a TM dielectric resonator body having a central portion with a plurality of arms extending outwardly from the central portion;

two input conductive members, each input conductive members positioned in a corresponding cavity, wherein each input conductive member is disposed proximate a corresponding TM dual-mode resonator for coupling between the input conductive member and the TM dual-mode resonator; and further comprising. for each cavity:

a first tuning member positioned proximate the dielectric resonator body in the cavity to preset the coupling, and a second tuning member positioned proximate the dielectric resonator body in the cavity for fine-tuning.

16. The filter of claim 15 wherein one dielectric resonator body comprises a cross shape.

17. The filter of claim 15 further comprising a tuning member for each cavity, positioned adjacent one or more of the plurality of arms of the dielectric resonator body in the cavity.

18. The filter of claim 17 wherein said mode tuning member is positioned adjacent two of the plurality of arms.

19. The filter of claim 18 wherein all tuning is in the same direction.

20. The filter of claim 15 further comprising a tuning member for each cavity, positioned adjacent one or more of the plurality of arms of the dielectric resonator body in the cavity, for tuning a magnetic field in the cavity.

21. The filter of claim 15 wherein at least two of the arms of the dielectric resonator body in each cavity are offset relative to the central portion of the dielectric resonator body.

22. The filter of claim 15 wherein at least one dielectric resonator body comprises an "X" shape.

23. The filter of claim 15 wherein, for each cavity:

the first tuning member comprises a step in a corner of the cavity; and the second tuning member comprises a tuning screw.

24. The filter of claim 15 wherein the tuning members comprise metals covered with dielectric film.

25. The filter of claim 15 wherein:

each cavity is essentially rectangular with essentially parallel top and bottom surfaces, and essentially parallel front and back surfaces;

at least one arm of said plurality of arms of the dielectric resonator body in each cavity is transverse relative to said cavity top and bottom surfaces; and the corresponding input conductive member is transverse relative to said top and bottom cavity surfaces.

26. The filter of claim 25 wherein each dielectric resonator body comprises an "X" shape.

27. A filter comprising:

an enclosure having two cavities separated by a wall;

two TM dual-mode resonators, each TM dual-mode resonator positioned in a corresponding cavity, each TM dual-mode resonator having first and second modes and comprising a TM dielectric resonator body having a central portion with a plurality of arms extending outwardly from the central portion;

two input conductive members, each input conductive members positioned in a corresponding cavity, wherein each input conductive member is disposed proximate a corresponding TM dual-mode resonator for coupling between the input conductive member and the TM dual-mode resonator; and a cross-coupling member disposed in the two cavities via a opening in the wall for coupling between resonator modes, wherein the cross-coupling member comprises a closed loop which is not connected to cavity surfaces.

28. The filter of claim 27 wherein the cross-coupling member is positioned adjacent the TM dielectric resonator bodies.

29. The filter of claim 27 wherein the cross-coupling member providing coupling between resonator modes 1 and 4.

30. The filter of claim 27 wherein the cross-coupling member comprises an "8" shape.

31. The filter of claim 27 wherein the cross-coupling member is printed on a double-sided substrate.

32. The filter of claim 27 wherein one dielectric resonator body comprises a cross shape.

33. A filter comprising:

an enclosure having a cavity;

a TM dual-mode resonator in the cavity, the TM dual-mode resonator having first and second modes and comprising a TM dielectric resonator body having a central portion with a plurality of arms extending outwardly from the central portion, the dielectric resonator body comprising an "X" shape defining a tilt angle γ between two arms of said plurality of arms of the dielectric resonator body, wherein the tilt angle γ ranges from about 66 degrees to about 83 degrees; and an input conductive member in the cavity, wherein the input conductive member is disposed proximate the TM dual-mode resonator for coupling between the input conductive member and the TM dual-mode resonator.

34. The filter of claim 33 wherein:

the dielectric resonator body is oriented in the cavity by an orientation angle ϕ relative to a centred point in the cavity whereby said arms of the dielectric resonator body are rotated around the centred point such that the arms are kept as far away as possible from the cavity surfaces to increase Q-value.

35. The filter of claim 34 wherein:

a first arm of said two arms of the dielectric resonator body is oriented in the cavity by the orientation angle ϕ relative to the input conductive member; and a second arm of said two arms of the dielectric resonator body, adjacent to the first arm, is oriented in the cavity by an orientation angle θ relative to the input conductive member, such that the orientation angles θ and ϕ sets said orientation angle γ between the first and second arms.

36. The filter of claim 35 wherein: the orientation angle θ ranges from about 59 degrees to about 67 degrees.

37. The filter of claim 36 wherein: the coupling Qe2 between the second arm and the input conductive member depends on the angle θ; and the relationship between the orientation angle θ, the coupling Qe2 and the coupling factor K12 is defined as:

| Angle θ | K12 | Qe2 |
|---|---|---|
| 59.4 | 0.0683 | 224 |
| 62.7 | 0.0438 | 282 |
| 66.3 | 0.0267 | 387. |

38. The filter of claim 35 wherein:

the orientation angle ϕ ranges from about 0 degrees to about 14 degrees.

39. The filter of claim 38 wherein: the coupling Qe1 between the first arm and the input conductive member depends on the angle ϕ; and the relationship between the orientation angle ϕ, the coupling Qe1 and the coupling factor K12 is defined as:

| Angle ϕ | Qe1 |
|---|---|
| 0 | 25.7 |
| 4.4 | 25.1 |
| 8.7 | 26.0 |
| 13.0 | 26.9. |

40. The filter of claim 34 wherein:

the coupling Qe2 between the second arm and the input conductive member depends on the angle θ, wherein the coupling Qe2 is dependent on the angle θ.

41. The filter of claim 40 wherein:

the coupling Qe1 between the first arm and the input conductive member depends on the angle ϕ, wherein the coupling Qe1 is dependent on the angle ϕ.

42. The filter of claim 33 wherein:

the dielectric resonator body is oriented in the cavity by an orientation angle θ relative to the input conductive member, whereby said arms of the dielectric resonator body are rotated in the cavity such that the arms are kept as far away as possible from the cavity surfaces to increase Q-value.

43. The filter of claim 33 wherein the input conductive member is tilted relative to the cavity surfaces, and the input conductive member has orientation angles ϕ and θ relative to the first and second arms of the dielectric resonator body, respectively, such that said orientation angles ϕ, θ are functions of said tilt of the input conductive member.

44. The filter of claim 43 wherein changing affects said orientation angles, resulting in changes in coupling between the arms and the input conductive member.

45. The filter of claim 33 wherein the relationship between the tilt angle γ and the coupling factor K12 is defined as

| Angle γ | K12 |
|---|---|
| 66.3 | 0.0806 |
| 70.1 | 0.0598 |
| 74.1 | 0.0416 |
| 78.3 | 0.0265 |
| 82.5 | 0.0215. |

* * * * *